US008959711B1

(12) United States Patent
Lawrence

(10) Patent No.: US 8,959,711 B1
(45) Date of Patent: Feb. 24, 2015

(54) DOOR STOP DEVICE

(71) Applicant: Russell T. Lawrence, Antioch, CA (US)

(72) Inventor: Russell T. Lawrence, Antioch, CA (US)

( * ) Notice: Subject to any disclaimer, the term of this patent is extended or adjusted under 35 U.S.C. 154(b) by 0 days.

(21) Appl. No.: 14/156,346

(22) Filed: Jan. 15, 2014

(51) Int. Cl.
*E05F 5/02* (2006.01)
*E05F 5/06* (2006.01)

(52) U.S. Cl.
CPC ..... *E05F 5/06* (2013.01)
USPC ..... 16/82

(58) Field of Classification Search
CPC ..... E05F 5/02; E05F 5/04; E05F 5/06; E05C 17/20
USPC ..... 16/49, 82; 292/338, 339, 262, 145, 146, 292/DIG. 15, DIG. 19; 49/394
See application file for complete search history.

(56) References Cited

U.S. PATENT DOCUMENTS

| | | | | | |
|---|---|---|---|---|---|
| 15,094 | A | * | 6/1856 | Warner | 292/145 |
| 646,810 | A | * | 4/1900 | Doyle, Jr. | 292/262 |
| 1,245,049 | A | * | 10/1917 | Silverstein | 292/145 |
| 2,704,220 | A | * | 3/1955 | Graham | 292/338 |
| 2,929,647 | A | * | 3/1960 | Gladstone | 292/60 |
| 3,805,322 | A | | 4/1974 | Serrano | |
| 4,050,723 | A | * | 9/1977 | Papadatos | 292/164 |
| 4,462,623 | A | | 7/1984 | Grant | |
| 5,018,241 | A | | 5/1991 | Baines | |
| 5,080,354 | A | * | 1/1992 | McDougall | 292/145 |
| 5,120,093 | A | * | 6/1992 | Carney | 292/60 |
| 5,125,695 | A | * | 6/1992 | Hartwell | 292/62 |
| 5,590,928 | A | | 1/1997 | Voiculescu | |
| 5,603,184 | A | * | 2/1997 | Campbell et al. | 49/394 |
| 6,336,245 | B1 | | 1/2002 | Sakakibara | |
| 6,467,125 | B1 | | 10/2002 | Johnson | |
| 6,684,570 | B1 | * | 2/2004 | Robledo | 49/394 |
| 6,866,309 | B1 | * | 3/2005 | Marks | 292/57 |
| 7,111,360 | B1 | | 9/2006 | Hsu | |
| 7,648,180 | B2 | * | 1/2010 | Petry | 292/137 |
| D612,717 | S | | 3/2010 | Frankel | |

* cited by examiner

*Primary Examiner* — William Miller

(57) ABSTRACT

A door stop device facilitates hands free obstruction of a door. The device includes a base having a top surface, a bottom surface, and a perimeter edge extending between the top surface and the bottom surface. A conduit extends through the base between the top surface and the bottom surface. A rod extends through the conduit. The rod is slidable within the conduit. A first block is coupled to a first end of the rod. A second block is coupled to a second end of the rod. The rod has a length greater than a length of the conduit such that the second block is in an extended position spaced apart from the base when the first block is positioned adjacent to the base.

18 Claims, 4 Drawing Sheets

DOOR STOP DEVICE

BACKGROUND OF THE DISCLOSURE

Field of the Disclosure

The disclosure relates to door stop devices and more particularly pertains to a new door stop device for facilitating hands free obstruction of a door.

SUMMARY OF THE DISCLOSURE

An embodiment of the disclosure meets the needs presented above by generally comprising a base having a top surface, a bottom surface, and a perimeter edge extending between the top surface and the bottom surface. A conduit extends through the base between the top surface and the bottom surface. A rod extends through the conduit. The rod is slidable within the conduit. A first block is coupled to a first end of the rod. A second block is coupled to a second end of the rod. The rod has a length greater than a length of the conduit such that the second block is in an extended position spaced apart from the base when the first block is positioned adjacent to the base.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
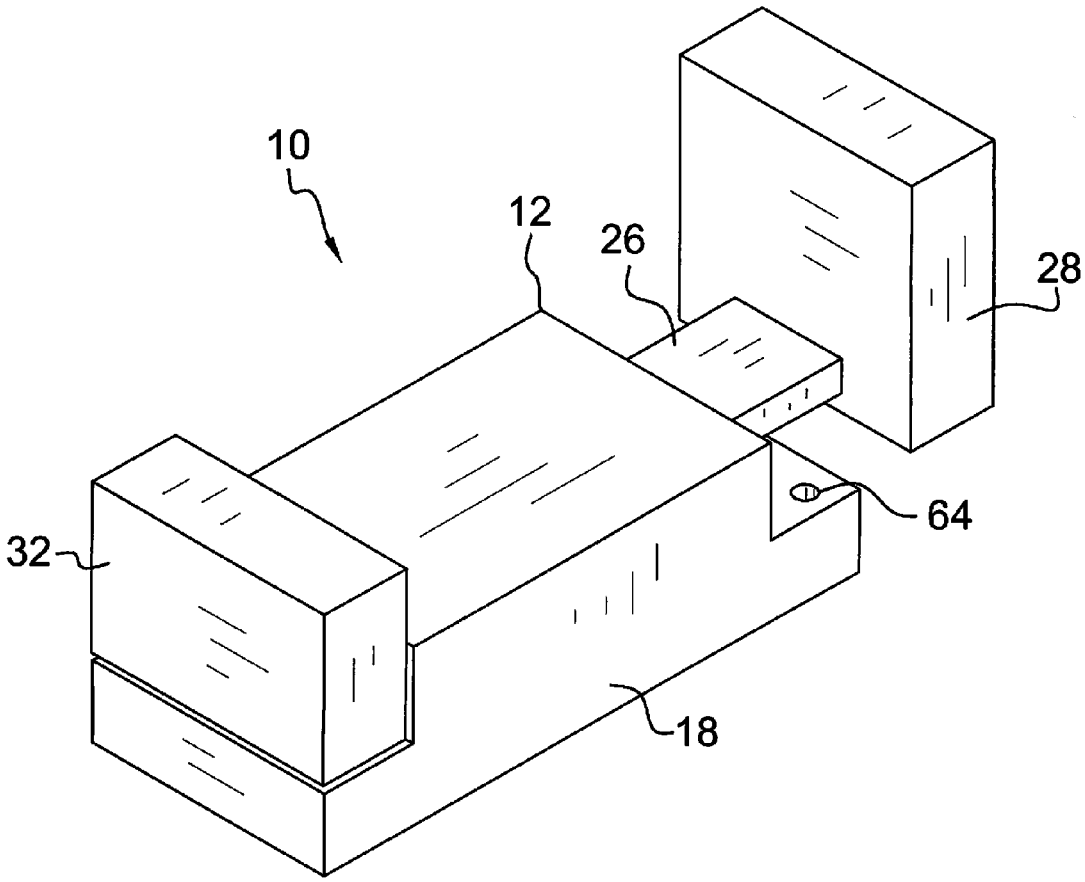
FIG. 1 is a top rear side perspective view of a door stop device according to an embodiment of the disclosure.
Figure 2:
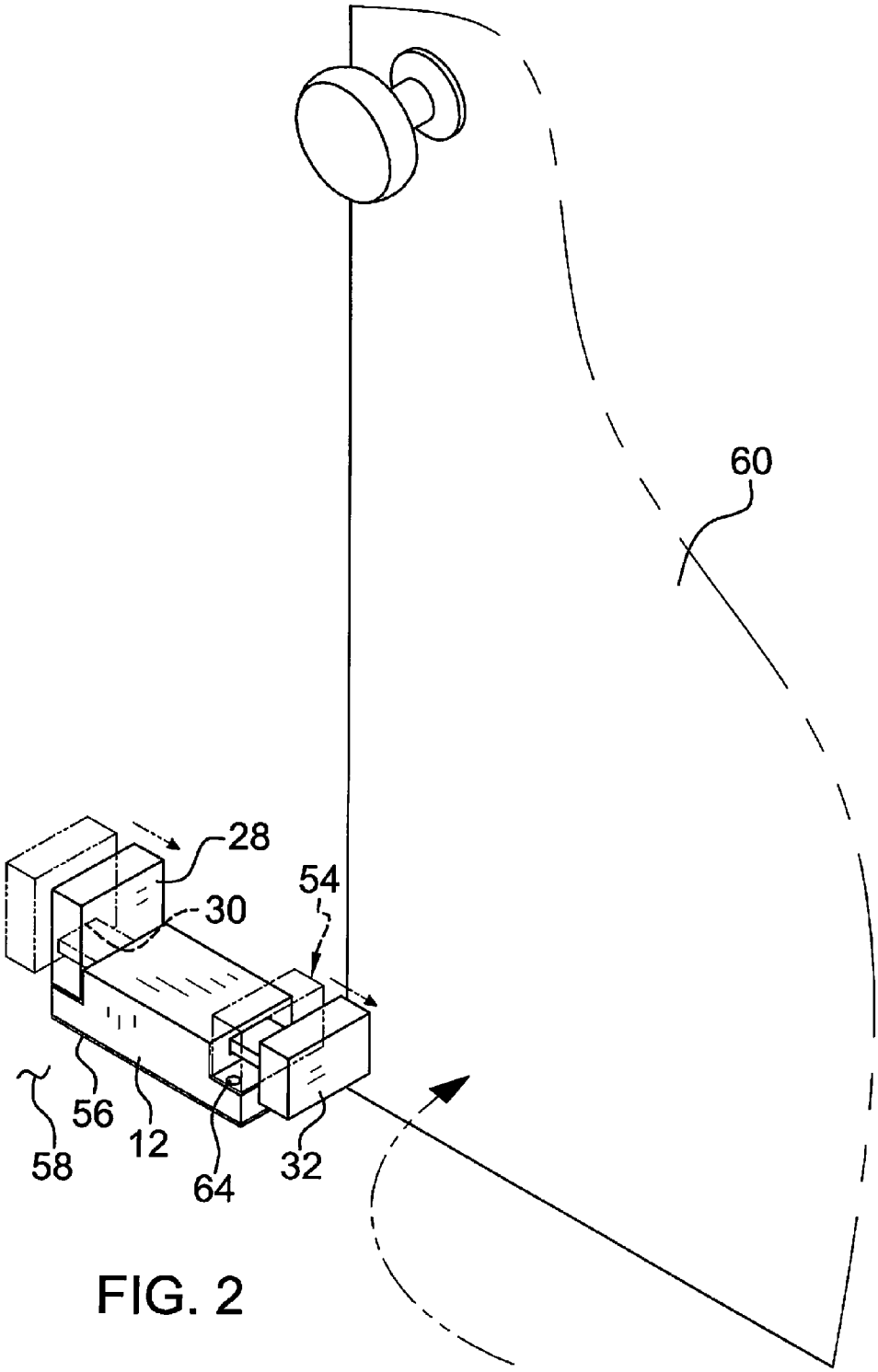
FIG. 2 is a top front side perspective view of an embodiment of the disclosure.
Figure 3:
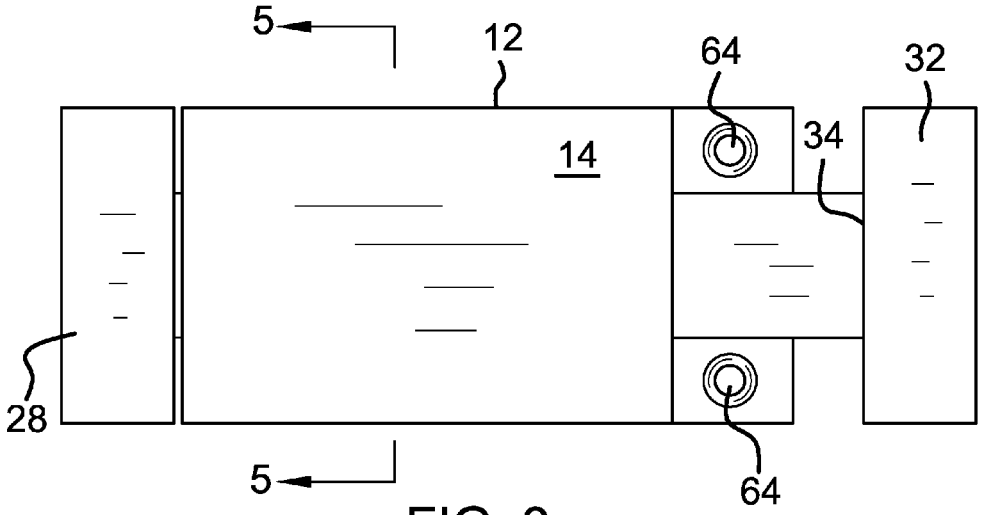
FIG. 3 is a top view of an embodiment of the disclosure.
Figure 4:
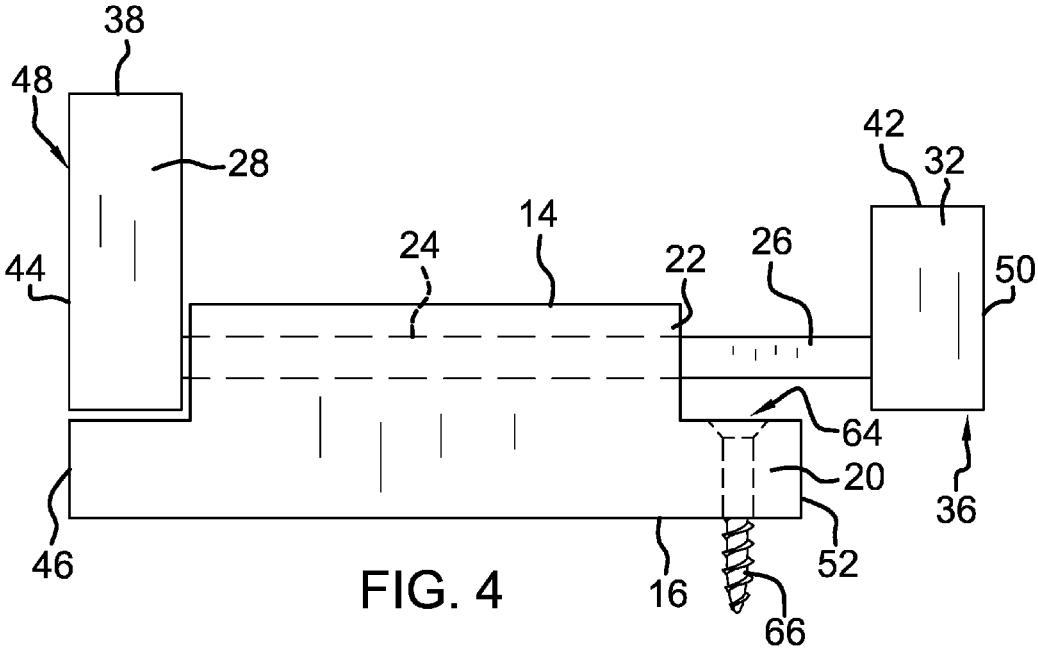
FIG. 4 is a front view of an embodiment of the disclosure.
Figure 5:
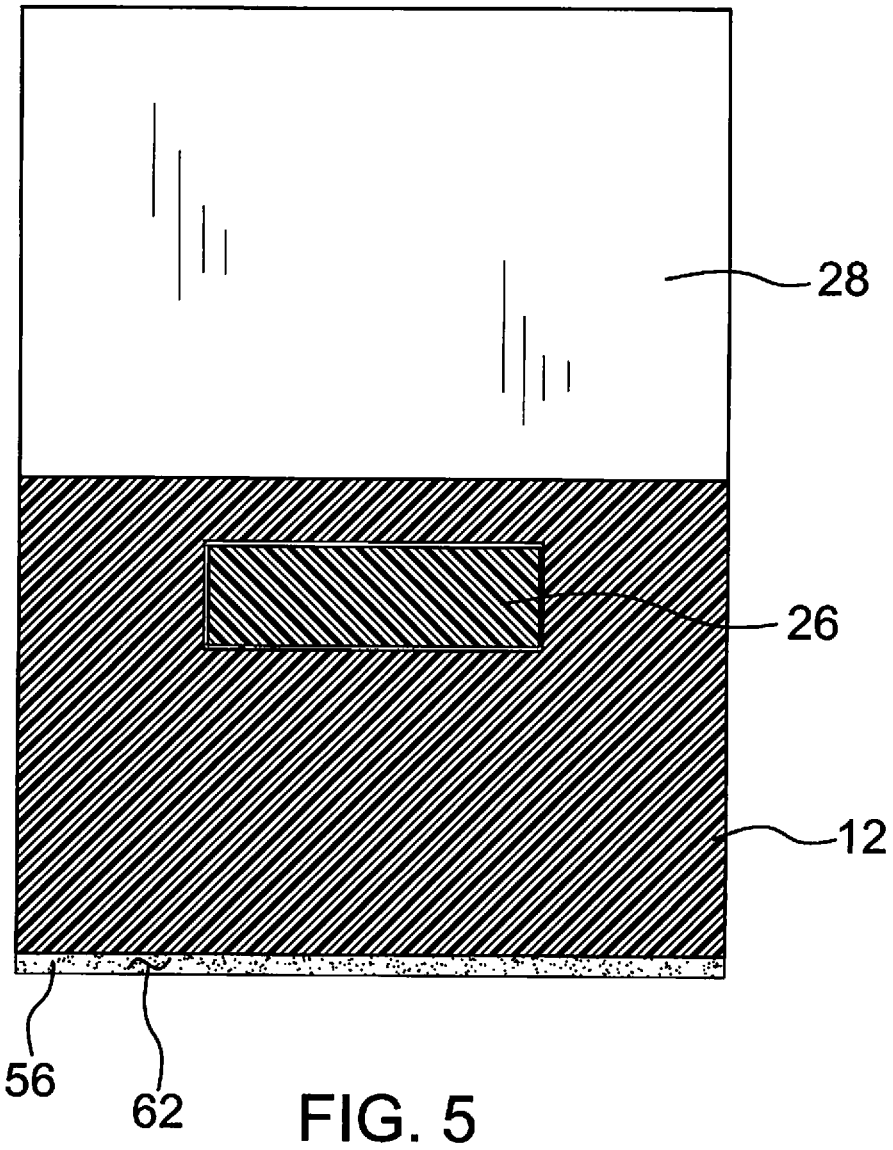
FIG. 5 is a cross-sectional view of an embodiment of the disclosure taken along line 5-5 of FIG. 3.

With reference now to the drawings, and in particular to FIGS. 1 through 5 thereof, a new door stop device embodying the principles and concepts of an embodiment of the disclosure and generally designated by the reference numeral 10 will be described.

As best illustrated in FIGS. 1 through 5, the door stop device 10 generally comprises a base 12 having a top surface 14, a bottom surface 16, and a perimeter edge 18 extending between the top surface 14 and the bottom surface 16. The base 12 has a lower section 20 and an upper section 22. A conduit 24 extends through the base 12 between the top surface 14 and the bottom surface 16. The conduit 24 extends through the upper section 22 of the base 12. The conduit 24 may have a rectangular transverse cross-sectional shape relative to a longitudinal axis of the conduit 24.

A rod 26 extends through the conduit 24. The rod 26 is slidable within the conduit 24. The rod 26 may have a rectangular transverse cross-sectional shape relative to a longitudinal axis of the rod 26. A first block 28 is coupled to a first end 30 of the rod 26. A second block 32 is coupled to a second end 34 of the rod 26. The rod 26 has a length greater than a length of the conduit 24 such that the second block 32 is in an extended position 36 spaced apart from the base 12 when the first block 28 is positioned adjacent to the base 12. Each of the first block 28, the second block 32 and the base 12 may be constructed from wood, plastic or the like.

A top surface 38 of the first block 28 is positioned in vertically spaced relationship to the top surface 14 of the base 12. A top surface 42 of the second block 32 is positioned in vertically spaced relationship to the top surface 14 of the base 12. The top surface 38 of the first block 28 is positioned in vertically spaced relationship higher than the top surface 42 of the second block 32 wherein the first block 28 is configured for facilitating moving the second block 32 relative to the base 12 using a foot.

An outer face 44 of the first block 28 relative to the base 12 is substantially coplanar with an adjacently positioned outer face 46 of the lower section 20 when the first block 28 is positioned in a retracted position 48 relative to the base 12. An outer face 50 of the second block 32 relative to the base 12 is substantially coplanar with an adjacently positioned outer face 52 of the lower section 20 when the second block 32 is positioned in a retracted position 54 relative to the base 12.

A fastener 56 is coupled to the base 12 wherein the base 12 is configured for being coupled to a surface 58 proximate a path of a pivoting door 60 in a fixed position such that the second block 32 is in the extended position 36. The fastener 56 may be an adhesive 62 coupled to and coextensive with the bottom surface 16 of the base 12. Alternatively, the fastener 56 may be at least one screw 66 inserted through holes 64 in the base 12 wherein the fastener 56 extends from the base 12.

In use, as stated above and shown in the Figures, the fastener 56 is attached to a surface 58 proximate a path of a pivoting door 60. The second block 32 is slid to the extended position 36 by sliding the first block 28 using a foot of a user. This allows the second block 32 to obstruct the door 60 as needed. To allow the door 60 to freely pivot, the second block 32 is slid to the retracted position 54 by sliding the first block 28 in the opposite direction using the user's foot.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A door stop device comprising:

a base having a top surface, a bottom surface, and a perimeter edge extending between said top surface and said bottom surface;

a conduit extending through said base between said top surface and said bottom surface;

a rod extending through said conduit, said rod being slidable within said conduit;

a first block coupled to a first end of said rod;

a second block coupled to a second end of said rod;

wherein said rod having a length greater than a length of said conduit such that said second block is in an extended position spaced apart from said base when said first block is positioned adjacent to said base;

said base having a lower section and an upper section, said conduit extending through said upper section of said base; and an outer face of said first block relative to said base being substantially coplanar with an adjacently positioned outer face of said lower section when said first block is positioned in a retracted position relative to said base.

2. The device of claim 1, further comprising a top surface of said first block being positioned in vertically spaced relationship to said top surface of said base.

3. The device of claim 2, further comprising a top surface of said second block being positioned in vertically spaced relationship to said top surface of said base.

4. The device of claim 3, further comprising said top surface of said first block being positioned in vertically spaced relationship higher than said top surface of said second block wherein said first block is configured for facilitating moving said second block relative to said base using a foot.

5. The device of claim 1, further comprising a fastener coupled to said base wherein said base is configured for being coupled to a surface proximate a path of a pivoting door in a fixed position such that said second block is in said extended position.

6. The device of claim 5, further comprising said fastener being at least one screw inserted through and extending from said base.

7. The device of claim 1, further comprising said rod having a rectangular transverse cross-sectional shape relative to a longitudinal axis of said rod.

8. The device of claim 1, further comprising:

said conduit having a rectangular transverse cross-sectional shape relative to a longitudinal axis of said conduit;

said rod having a rectangular transverse cross-sectional shape relative to a longitudinal axis of said rod;

a top surface of said first block being positioned in vertically spaced relationship to said top surface of said base;

a top surface of said second block being positioned in vertically spaced relationship to said top surface of said base, said top surface of said first block being positioned in vertically spaced relationship higher than said top surface of said second block wherein said first block is configured for facilitating moving said second block relative to said base using a foot;

an outer face of said second block relative to said base being substantially coplanar with an adjacently positioned outer face of said lower section when said second block is positioned in a retracted position relative to said base;

a fastener coupled to said base wherein said base is configured for being coupled to a surface proximate a path of a pivoting door in a fixed position such that said second block is in said extended position.

9. The device of claim 8, further comprising said fastener being an adhesive coupled to and coextensive with said bottom surface of said base.

10. The device of claim 8, further comprising said fastener being at least one screw inserted through and extending from said base.

11. A door stop device comprising:

a base having a top surface, a bottom surface, and a perimeter edge extending between said top surface and said bottom surface;

a conduit extending through said base between said top surface and said bottom surface;

a rod extending through said conduit, said rod being slidable within said conduit;

a first block coupled to a first end of said rod;

a second block coupled to a second end of said rod;

wherein said rod having a length greater than a length of said conduit such that said second block is in an extended position spaced apart from said base when said first block is positioned adjacent to said base; and a fastener coupled to said base wherein said base is configured for being coupled to a surface proximate a path of a pivoting door in a fixed position such that said second block is in said extended position, said fastener being an adhesive coupled to and coextensive with said bottom surface of said base.

12. A door stop device comprising:

a base having a top surface, a bottom surface, and a perimeter edge extending between said top surface and said bottom surface;

a conduit extending through said base between said top surface and said bottom surface;

a rod extending through said conduit, said rod being slidable within said conduit;

a first block coupled to a first end of said rod;

a second block coupled to a second end of said rod;

wherein said rod having a length greater than a length of said conduit such that said second block is in an extended position spaced apart from said base when said first block is positioned adjacent to said base;

said base having a lower section and an upper section, said conduit extending through said upper section of said base; and an outer face of said second block relative to said base being substantially coplanar with an adjacently positioned outer face of said lower section when said second block is positioned in a retracted position relative to said base.

13. The device of claim 12, further comprising a top surface of said first block being positioned in vertically spaced relationship to said top surface of said base.

14. The device of claim 13, further comprising a top surface of said second block being positioned in vertically spaced relationship to said top surface of said base.

15. The device of claim 14, further comprising said top surface of said first block being positioned in vertically spaced relationship higher than said top surface of said second block wherein said first block is configured for facilitating moving said second block relative to said base using a foot.

16. The device of claim 12, further comprising a fastener coupled to said base wherein said base is configured for being coupled to a surface proximate a path of a pivoting door in a fixed position such that said second block is in said extended position.

17. The device of claim 16, further comprising said fastener being an adhesive coupled to and coextensive with said bottom surface of said base.

18. The device of claim 12, further comprising said rod having a rectangular transverse cross-sectional shape relative to a longitudinal axis of said rod.

* * * * *